US009919236B1

(12) United States Patent
Gross

(10) Patent No.: US 9,919,236 B1
(45) Date of Patent: Mar. 20, 2018

(54) BMX STARTING GATE

(71) Applicant: Thomas Andrew Gross, Overland Park, KS (US)

(72) Inventor: Thomas Andrew Gross, Overland Park, KS (US)

( * ) Notice: Subject to any disclaimer, the term of this patent is extended or adjusted under 35 U.S.C. 154(b) by 0 days.

(21) Appl. No.: 15/365,582

(22) Filed: Nov. 30, 2016

(51) Int. Cl.
*A63K 3/02* (2006.01)
*E01F 13/08* (2006.01)
*A63B 69/16* (2006.01)

(52) U.S. Cl.
CPC ..... *A63K 3/02* (2013.01); *A63B 69/16* (2013.01); *E01F 13/08* (2013.01)

(58) Field of Classification Search
CPC ..... A63K 3/02; A63B 69/16; E01F 13/08
See application file for complete search history.

(56) References Cited

U.S. PATENT DOCUMENTS 1,531,987 A * 3/1925 Smith ..... B61L 29/026 116/63 R
3,911,857 A * 10/1975 Manuel ..... A63B 69/16 116/313
4,134,230 A * 1/1979 Roy ..... A63K 3/02 472/85
7,900,399 B2 * 3/2011 Williams ..... A63K 3/023 404/9
9,770,669 B2 * 9/2017 Romer, Jr. ..... A63K 3/02
2005/0069383 A1 * 3/2005 Gunderson ..... A63K 3/02 404/6
2006/0029467 A1 * 2/2006 Johnson ..... A63K 3/02 404/60
2007/0248409 A1 * 10/2007 Barker ..... A63K 3/02 404/6

* cited by examiner

*Primary Examiner* — Gregory J Strimbu
(74) *Attorney, Agent, or Firm* — Mark H. Plager

(57) ABSTRACT

A BMX starting gate includes a frame with a gate opening; a slider bar attached to a bottom surface of the frame; a gate pivotally attached to the frame at a connection point such that the gate aligns with the gate opening; a linkage bar attached to the gate proximate to the connection point; a lever attached to the linkage bar distal from the gate, wherein both the linkage bar and the lever are slidably attached to the slider bar; a strike plate attached to the lever distal from the linkage bar; an electromagnet attached to the frame, wherein the electromagnet is positioned to releasably engage with the strike plate; and a spring connecting the gate to the slider bar. Activating the electromagnet causes the electromagnet to engage the strike plate and cause the gate to extend outwardly from the frame. Deactivating the electromagnet allows the spring to return the gate to a non-obstructing position.

5 Claims, 4 Drawing Sheets

BMX STARTING GATE

BACKGROUND

The embodiments herein relate generally to bicycle motocross (BMX), and more particularly, to a BMX starting gate for, for example, practicing starting technique at home.

BMX racers need an affordable way to recreate the experience of the racetrack's starting gate at home. Existing starting gates include a 7 foot ramp platforms and expensive strong magnets or pneumatic ramjets to operate, resulting in the conventional starting gates to be far too expensive for most riders.

Therefore, what is needed is a BMX starting gate that uses less materials and a structure that greatly lowers the cost of the start gate as compared to conventional starting gates.

SUMMARY

Some embodiments of the present disclosure include a BMX starting gate including a frame with a gate opening; a slider bar attached to a bottom surface of the frame; a gate pivotally attached to the frame at a connection point such that the gate aligns with the gate opening; a linkage bar attached to the gate proximate to the connection point; a lever attached to the linkage bar distal from the gate, wherein both the linkage bar and the lever are slidably attached to the slider bar; a strike plate attached to the lever distal from the linkage bar; an electromagnet attached to the frame, wherein the electromagnet is positioned to releasably engage with the strike plate; and a spring connecting the gate to the slider bar. When the Activating the electromagnet may engage the strike plate and cause the gate to extend outwardly from the frame. Deactivating the electromagnet disengages the strike plate, releasing the gate.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
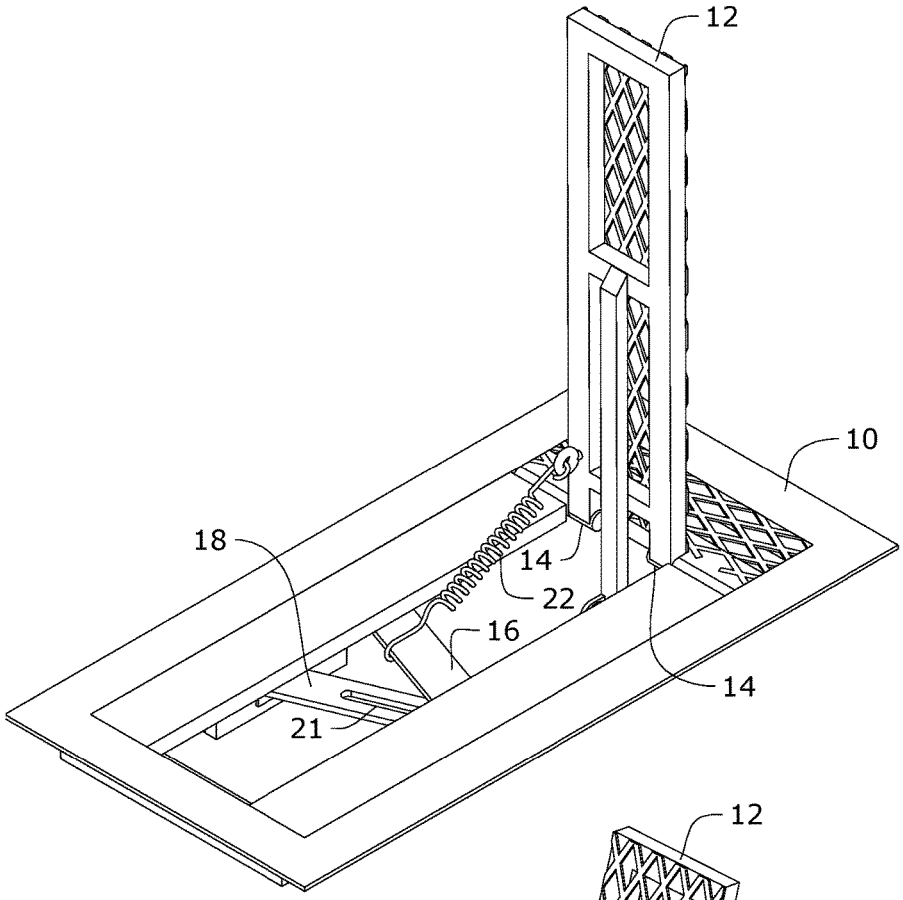
FIG. 1 is a front perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a practice BMX starting gate and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Frame
2. Gate
3. Hinge
4. Slider Bar
5. Lever
6. Linkage Bar
7. Spring
8. Electromagnet
9. Strike Plate
10. Latching Bar
11. Retention Tabs
12. Hand Tightening Knobs
13. Friction Pad The various elements of the device of the present disclosure may be related in the following exemplary fashion. It is not intended to limit the scope or nature of the relationships between the various elements and the following examples are presented as illustrative examples only.

By way of example, and referring to FIGS. 1-8, some embodiments of the present disclosure include a BMX starting gate to practice starting, the BMX starting gate comprising a frame 10 with a gate opening; a slider bar 16 attached to a bottom surface of the frame 10, the slider bar 16 comprising a slider channel 17 in a portion thereof, the slider channel 17 running parallel to the gate opening; a gate 12 attached to the frame 10 at a connection point such that the gate 12 aligns with the gate opening, the gate opening being sized to accommodate the gate 12; a linkage bar 20 attached to the gate 12 proximate to the connection point; a lever 18 attached to an end of the linkage bar 20 distal from the gate 12, the lever 18 comprising a lever channel 21 extending along at least a portion of a length of the lever 18; a slider pin 19 extending through the linkage bar 20 and the lever 18 and engaging with the slider channel 17, such that the linkage bar 20 and the lever 18 are slidably engaged with the slider channel 17; a hand tightening knob 32 attached to and extending outwardly from the slider bar 16, wherein a stem of the hand tightening knob 32 extends through the lever channel 21, such that the lever 18 is sandwiched between the hand tightening knob 32 and the slider bar 16; a strike plate 26 attached to an end of the lever 18 distal from the linkage bar 20; an electromagnet attached to the frame 10 opposite the slider channel 17, wherein the electromagnet 24 is positioned to releasably engage with the strike plate 26; and a spring 22 connecting the gate 12 to the slider bar 16.

Some embodiments of the starting gate of the present disclosure further comprise a plurality of retention (or stability) tabs 30. For example, the starting gate may comprise a pair of retention tabs 30, wherein a first retention tab 30 is positioned proximate to a first corner of the frame 10 proximate to the gate connection point, and the second retention tab 30 is positioned proximate to a second corner of the frame 10 proximate to the gate connection point.

Figure 2:
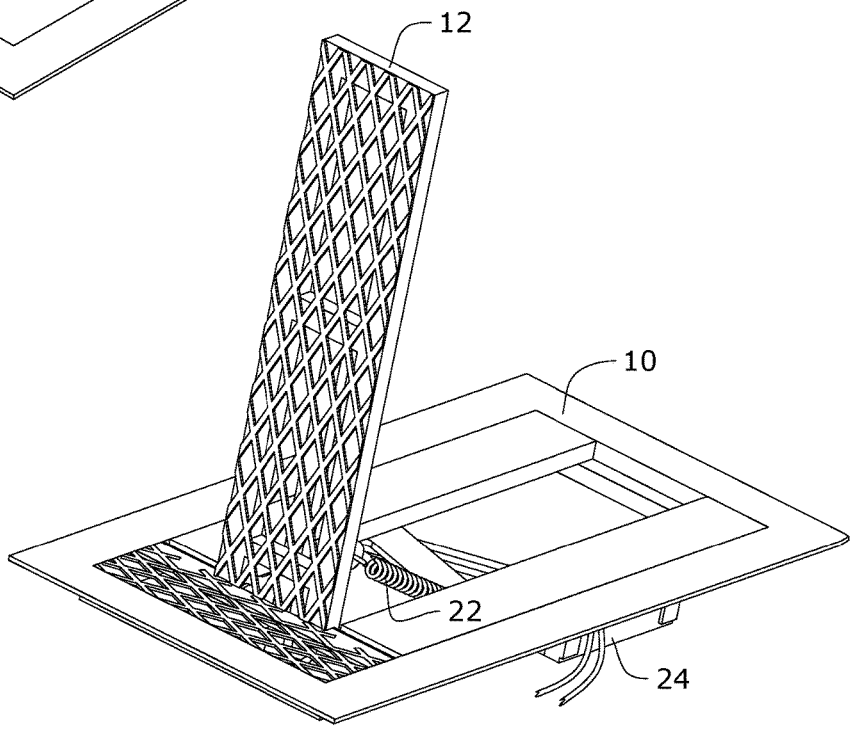
FIG. 2 is a rear perspective view of one embodiment of the present disclosure.
Figure 3:
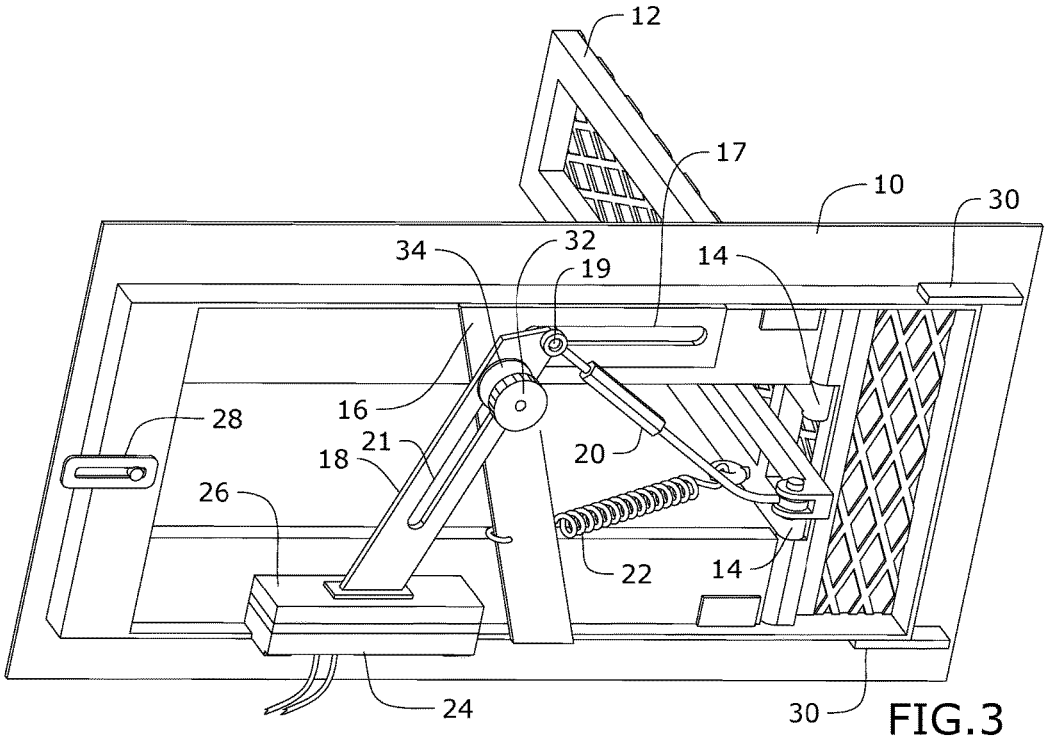
FIG. 3 is a bottom perspective view of one embodiment of the present disclosure.
Figure 4:
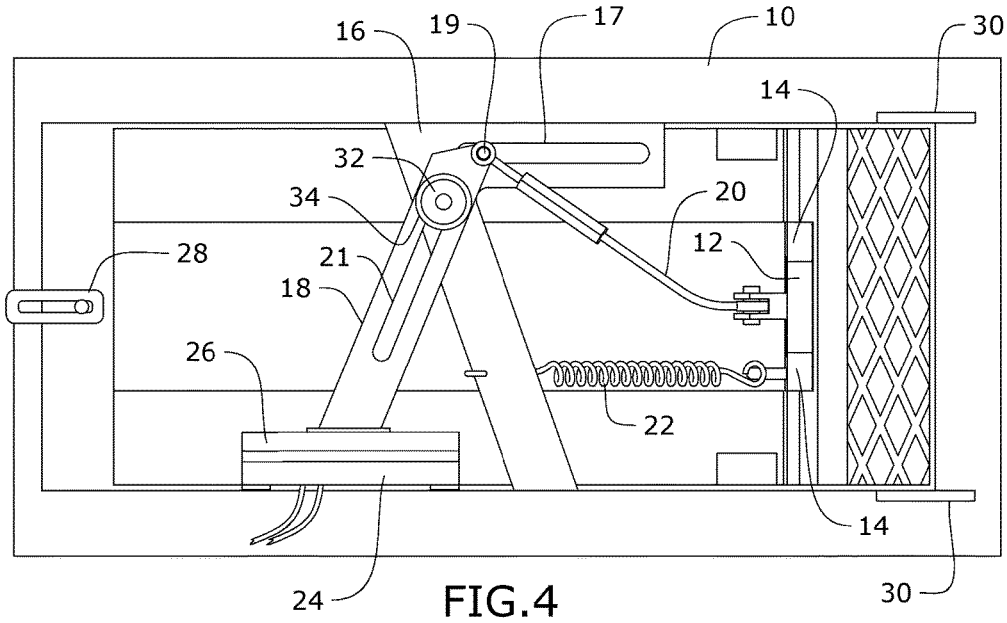
FIG. 4 is a bottom view of one embodiment of the present disclosure.
Figure 5:
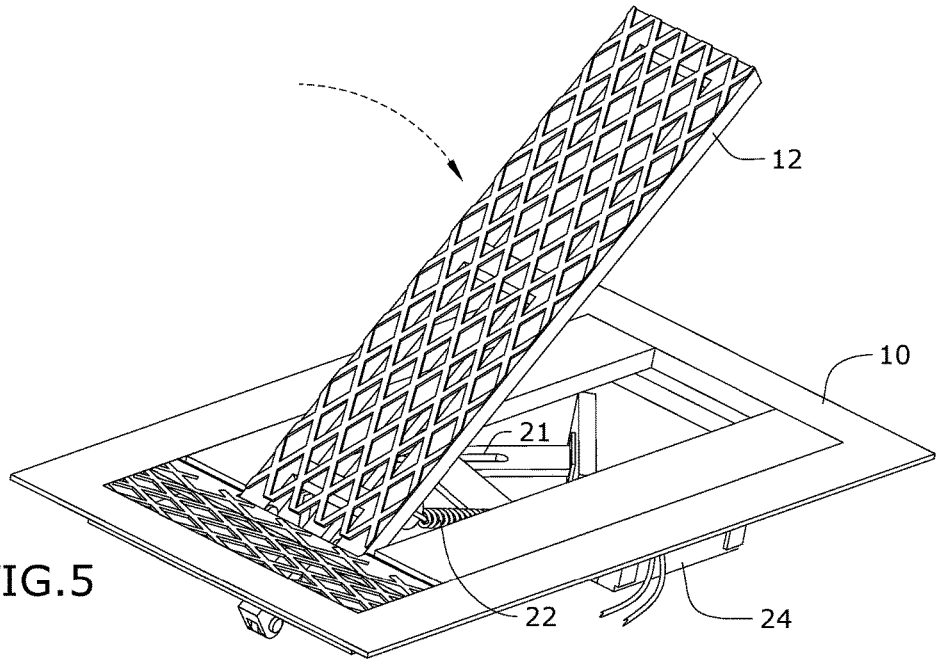
FIG. 5 is a front perspective view of one embodiment of the present disclosure.
Figure 7:
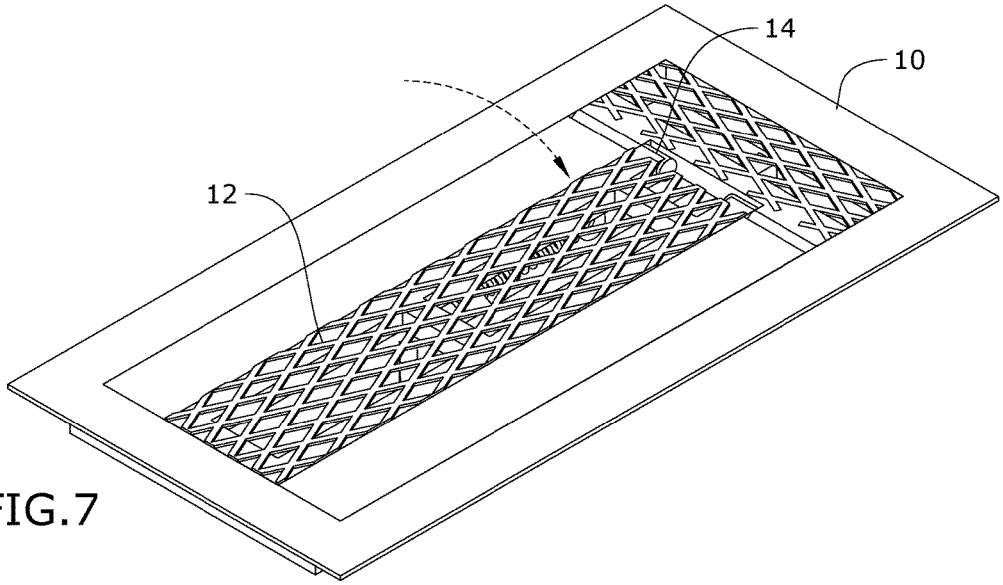
FIG. 7 is a perspective view of one embodiment of the present disclosure.
Figure 8:
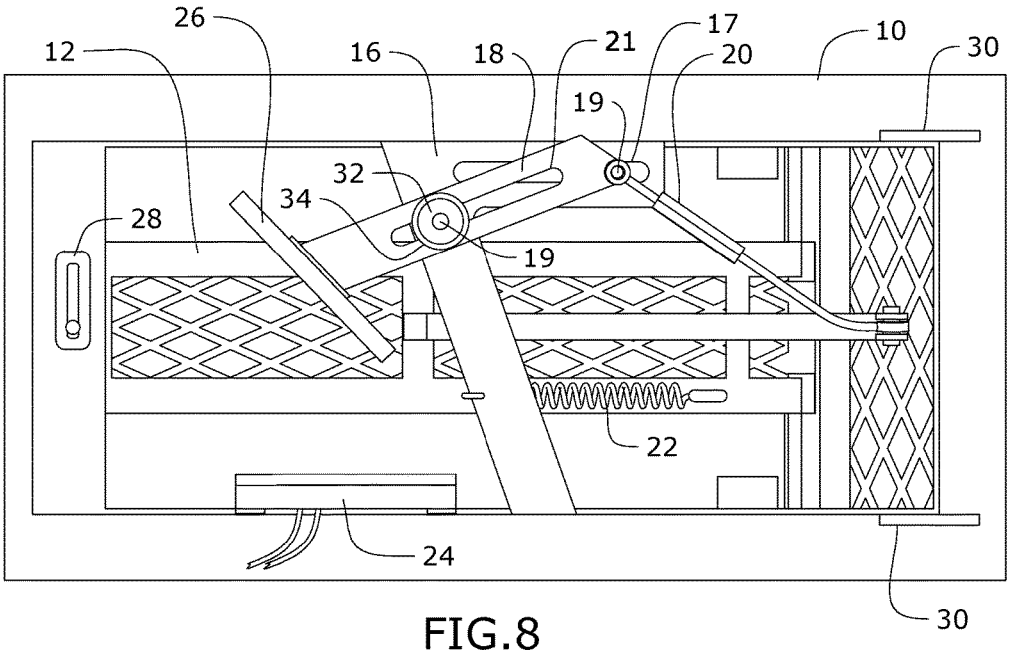
FIG. 8 is a bottom view of one embodiment of the present disclosure.

In some embodiments, the gate 12 is attached to the frame 10 via hinges 14, such as a pair of hinges 14, wherein the hinges 14 allow the gate 12 to pivot from an angle of about 90° with respect to a plane of the frame 10, as shown in FIGS. 1-3, to an angle of about 0° with respect to the plane of the frame 10, as shown in FIGS. 7 and 8.

In embodiments, a friction pad 34 may be positioned between a bottom surface of the hand tightening knob 32 and a top surface of the lever 18. The friction pad 34 may function to adjust the rate at which the gate 12 falls, while simultaneously providing more versatility to accommodate various starting techniques.

The Figures merely show one exemplary embodiment of the device of the present disclosure. However, it is understood that the components may be rearranged while maintaining the same functionality. For example, the spring 22 may alternatively wrap under the hinge 14, similar to an old screen door, which may improve the reliability of the device.

While not shown in the Figures, the starting gate of the present disclosure may further comprise a plate covering, such as a diamond steel plate covering, attached to a top of both the gate 12 and the frame 10. The plate covering may provide a riding surface for the racer, while simultaneously providing a mechanism for holding the starting gate in place, as the plate covering may have dimensions slightly larger than the frame 10 and gate 12, thus overhanging the frame 10.

Figure 6:
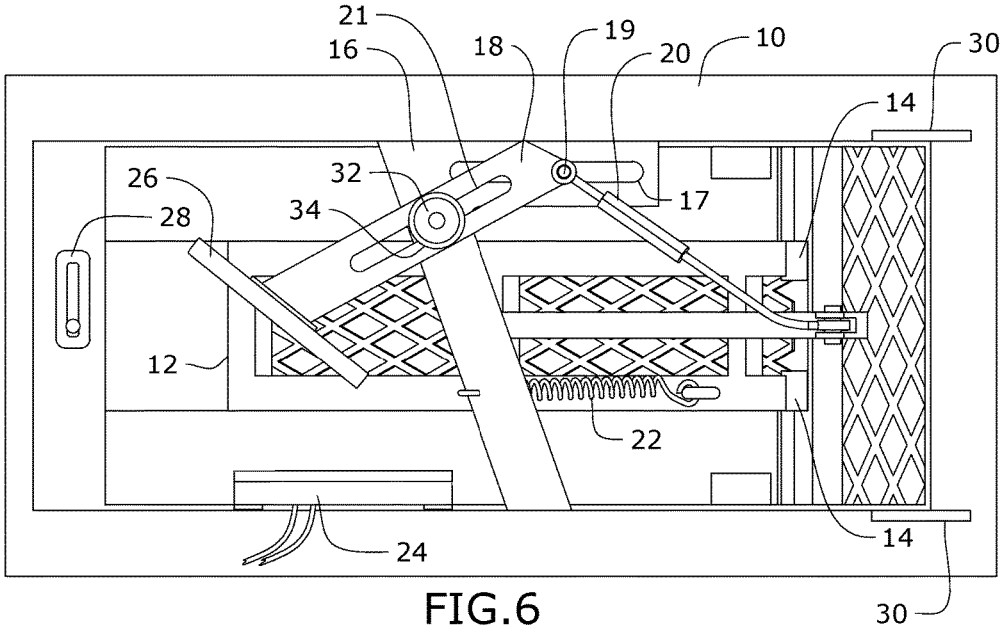
FIG. 6 is a bottom view of one embodiment of the present disclosure.

When the starting gate is in a ready position, the gate 12 may be at a 90° angle with respect to the frame 10, as shown in FIGS. 1-3. The electromagnet 24 may be powered on using a power source (not shown), causing the strike plate 26 to be engaged with the electromagnet 24. As a result, potential energy may be stored in the spring 22. When the electromagnet 24 is deactivated, the strike plate 26 may be released, allowing the lever 18 to pivot about the hand adjustment knob 32 and slide along the slider channel 17. Because the lever 18 may be attached to the adjustable linkage bar 20 by the slider pin 19, movement of the lever 18 along the slider channel 17 subsequently causes the adjustable linkage bar 20 to also slide along the slider channel 17, which causes the adjustable linkage bar 20 to pull on the gate 12, dropping the gate 12 into a flush position (i.e., 0° angle with respect to the frame 10), as shown in FIGS. 6 and 7. The retention tabs 30 may secure the gate 12 in this flush position.

When desired, the adjustable linkage bar 20 may be adjusted by turning a turnbuckle built into the linkage bar 20 and, as a result, the gate 12 can be adjusted to extend upwards from the frame 10 at any desired angle. For example, the linkage bar 20 may adjusted such that the gate 12 extends substantially perpendicularly from the frame 10. Additionally, the hand tightening knob 32 may be adjusted simply by rotating the knob clockwise or counter clockwise. As a result, the pressure that the friction pad 34 exerts on the lever 18 may be increased or decreased, as desired.

To use the device of the present disclosure, a user may mount it to an inclined ramp by sliding the retention tabs 30 under the surface of the ramp. Any conventional or existing starting system may be attached to the electromagnet 24 and, when engaged, provides power to the electromagnet 24. The gate 12 may be raised by pulling upwards on the gate 12 until it reaches an angle of about 90° with respect to the frame 10, causing the electromagnet 24 to engage the strike plate 26, holding the gate 12 in place. When the starting system is activated, the electromagnet 24 may be turned off, allowing the gate 12 to fall.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bicycle motocross starting gate, the starting gate comprising:

a frame with a gate opening;

a slider bar attached to a bottom surface of the frame, the slider bar comprising a slider channel which runs parallel to a longitudinal axis of the gate opening;

a gate pivotally attached to the frame at a connection point such that the gate is aligned with the gate opening, the gate opening being sized to accommodate the gate;

a linkage bar attached to the gate proximate the connection point;

a lever attached to an end of the linkage bar distal from the gate, wherein both the linkage bar and the lever are slidably attached to the slider bar;

a slider pin extending through the linkage bar and the lever and engaging with the slider channel, such that the linkage bar and the lever are slidably engaged with the slider channel;

a strike plate attached to an end of the lever distal from the linkage bar;

an electromagnet attached to the frame, wherein the electromagnet is positioned to releasably engage with the strike plate; and a spring connecting the gate to the slider bar, wherein:

when the electromagnet is activated, the electromagnet engages with the strike plate, causing the gate to extend away from the frame; and when the electromagnet is deactivated, the strike plate is disengaged with the electromagnet, causing the spring to position the gate within the gate opening.

2. The bicycle motocross starting gate of claim 1, wherein the gate is attached to the frame such that the gate can pivot from a first position flush with the frame to a second position substantially perpendicular to the frame.

3. The bicycle motocross starting gate of claim 2, wherein the gate is attached to the frame by a pair of hinges.

4. The bicycle motocross starting gate of claim 1, further comprising a knob attached to and extending away from the slider bar, wherein:

the lever comprises a lever channel extending through at least a portion thereof; and a stem of the knob extends through the lever channel, such that the lever is sandwiched between the knob and the slider bar.

5. The bicycle motocross starting gate of claim 1, further comprising a pair of retention tabs, wherein:

a first retention tab of the pair of retention tabs is positioned proximate a first corner of the frame; and the second retention tab of the pair of retention tabs is positioned proximate a second corner of the frame.

* * * * *